United States Patent [19]

Platt

[11] 4,199,644

[45] Apr. 22, 1980

[54] METHOD FOR THE PRODUCTION OF A NEEDLED NONWOVEN FABRIC

[75] Inventor: Louis Platt, Seneca, S.C.

[73] Assignee: Phillips Petroleum Company, Bartlesville, Okla.

[21] Appl. No.: 860,264

[22] Filed: Dec. 13, 1977

[51] Int. Cl.[2] ..... B29D 27/00; D04H 18/00

[52] U.S. Cl. ..... 428/300; 28/107; 28/112; 156/148; 264/25; 264/126; 425/83.1; 428/301

[58] Field of Search ..... 28/107, 111, 112, 115; 264/126, 25; 425/83.1; 428/301, 300; 156/148; 19/161 R, 163

[56] References Cited

U.S. PATENT DOCUMENTS

| | | | |
|---|---|---|---|
| 461,602 | 10/1891 | Boult | 28/115 |
| 3,432,896 | 3/1969 | Meagher | 28/115 |
| 4,042,655 | 8/1977 | Platt et al. | 28/107 |

*Primary Examiner*—Louis Rimrodt

[57] ABSTRACT

A nonwoven fabric is produced from a batt of staple fibers by passing the unneedled batt of staple fibers to at least two needling zones, each needling zone having a plurality of needles which move in a reciprocating motion having a first needling direction and a second needling direction, the needles in a first needling zone having barbs which catch staple fibers of the batt primarily when the needles move only in the first needling direction and the needles in a second needling zone having barbs which catch staple fibers of the batt when the needles move in both the first needling direction and the second needling direction.

31 Claims, 7 Drawing Figures

METHOD FOR THE PRODUCTION OF A NEEDLED NONWOVEN FABRIC

BACKGROUND OF THE INVENTION

The invention relates to a method and apparatus for needling a nonwoven batt of staple fibers. In another aspect the invention relates to a method and apparatus for producing a nonwoven fabric. In still another aspect the invention relates to a nonwoven fabric and a laminate employing said fabric.

In the last twenty-five years or so the development of polymeric materials has seen a tremendous growth. Polymeric materials lend themselves to a vast number of uses and applications. One of the more significant areas in which polymeric materials have been used is in the textile industry. The melt spinning of thermoplastic synthetic materials to produce continuous filaments, staple and yarns of such materials has revolutionized the textile industry.

Although much of the growth of the synthetic fiber industry has resulted because of the use of such fibers in knitted or woven fabrics, nonwoven materials of synthetic fibers also have experienced substantial growth. There are a number of methods known today for producing nonwoven fabrics from synthetic filaments and from mixtures of natural and synthetic filaments and such nonwoven fabrics find a variety of uses. A specific area in which nonwoven fabrics have gained acceptance is in the manufacture of carpets, particularly as the primary and/or secondary backing material. Since nonwoven fabrics made of synthetic fibers resist deterioration caused by mildew much better than jute, the material generally used, carpets made using synthetic nonwoven fabrics as the backing material are excellent carpets for use in areas exposed to moisture, such as bathrooms or patios and other outdoor areas.

Nonwoven fabrics are being used in many other areas as well. For example, nonwoven fabrics both fused and unfused are used as substrates in the production of various laminates and as ticking material in the furniture industry. While nonwovens are useful in a variety of applications and indeed have been commercially successful, there is still a need to improve the dimensional stability and strength of nonwoven fabrics produced from a needled batt of staple fibers.

It is an object of the present invention to produce a nonwoven fabric by needling a batt of staple fibers.

Another object of the invention is to produce a nonwoven fabric with improved dimensional stability and strength as compared to nonwoven fabrics known in the art.

Another object of the invention is a nonwoven fabric suitable for producing a laminate with improved properties as compared to comparable laminates.

Another object of the invention is a method and apparatus for needling a batt of staple fibers.

Other objects, aspects and advantages of the invention will be apparent after studying the specification and the appended claims.

SUMMARY

According to the invention a nonwoven batt of staple fibers is needled employing at least two needling zones, each needling zone having a plurality of needles which move in a reciprocating motion having a first needling direction and a second needling direction, the needles in a first needling zone having barbs which catch staple fibers of the batt primarily when the needles move only in the first needling direction and the needles in a second needling zone having barbs which catch staple fibers of the batt when the needles move in both the first needling direction and the second needling direction. Such a method for needling a batt of staple fibers produces a nonwoven fabric having substantially improved strength as compared to prior art nonwoven fabrics of comparable weight. Needling apparatus to carry out the above method is also provided.

Further according to the invention a nonwoven fabric is produced by forming a batt comprising fibers oriented primarily in a first direction, drafting the batt in a second direction in a first drafting zone, said second direction being primarily perpendicular to said first direction, needling the drafted batt employing the needling method described above, drafting the needled batt in the second direction in a second drafting zone, and drafting the drafted, needled batt in the first direction in a third drafting zone. The improved needling method in combination with the three drafting steps produces a nonwoven fabric with excellent physical properties.

The invention includes apparatus for performing the above-described process for producing a drafted needled nonwoven fabric, the fabric per se and a laminate made with the fabric.

BRIEF DESCRIPTION OF THE DRAWING

To further describe the invention the attached drawings are provided in which.

DETAILED DESCRIPTION OF THE INVENTION

It has been found that a nonwoven fabric manufactured by needling a batt of staple fibers can be produced with greater strength and better dimensional stability as compared to prior art nonwoven fabrics of comparable weight made of staple fibers when the method and apparatus for needling a nonwoven batt of staple fibers according to the present invention are employed. While a nonwoven batt of staple fibers suitable for needling in accordance with the present invention can be produced by any means known in the prior art, one method and apparatus which has been used is shown in FIGS. 1 and 2.

Figure 1:
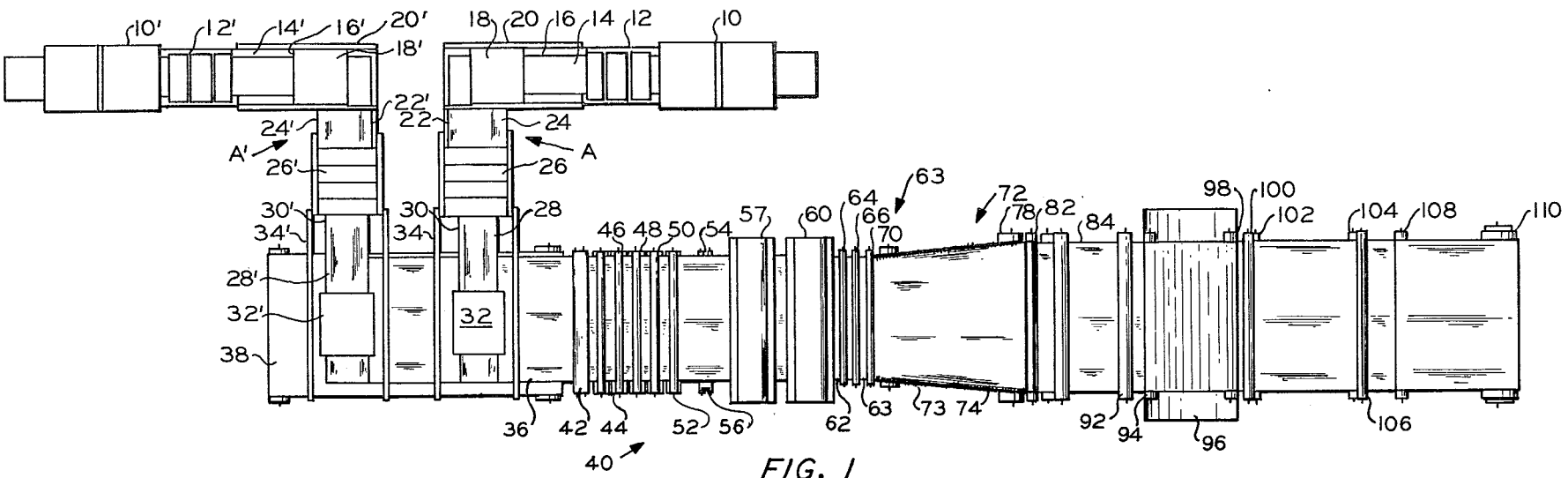
FIG. 1 is a top view of the schematic representation of an embodiment of the apparatus of the invention.
Figure 2:
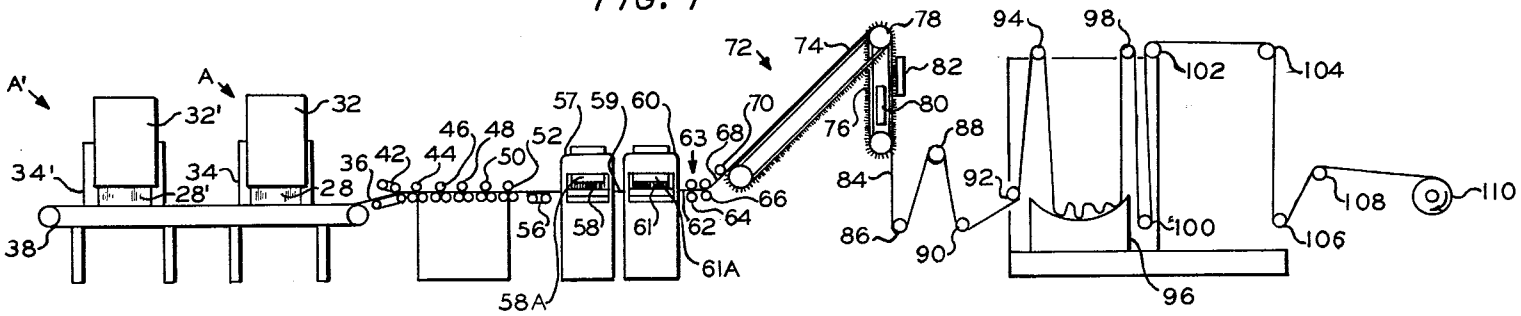
FIG. 2 is an elevational view of the apparatus of FIG. 1.

Referring to the drawings and in particular FIGS. 1 and 2 there is shown a batt-forming means comprising two web-forming trains A and A' in which feed means 10,10' such as a bale breakers, blender boxes, feed boxes, etc. as known in the art, feed fibers in the form of staple, such as polypropylene staple, to breaker carding machines 12,12'. The carding machines 12,12' produce carded webs 14,14' of fibers which are picked up by the takeoff aprons 16,16' of crosslappers 20,20'. Crosslappers 20,20' also comprise lapper aprons 18,18' which traverse a carrier means, such as intermediate aprons 22,22', in a reciprocating motion laying the webs 14,14' to form intermediate batts 24,24' on the intermediate aprons 22,22'. The intermediate batts 24,24' are passed to finisher carding machines 26,26' by intermediate aprons 22,22'. Carding machines 26,26' produce carded webs 28,28' which are picked up by takeup aprons 30,30' of crosslappers 34,34'. Crosslappers 34,34' also comprise lapper aprons 32,32' which form a batt of fibers 36 as the lapper aprons 32,32' traverse floor apron 38.

The carded webs 28,28' are laid on floor apron 38 to build up several thicknesses to produce nonwoven batt 36. The fibers of batt 36 are oriented essentially transverse to the direction of movement of floor apron 38. It is pointed out that only one feed means, carding machine, and crosslapper are actually needed to form a batt. The use of two carding machines such as a breaker carding machine and a finisher carding machine and associated aprons and crosslappers tend to open up the fibers better to form a more uniform web and to provide some randomization of the staple fibers forming the webs which form the batt. Also two web-forming trains A and A' or more are used to increase the speed of the overall operation, and thus the use of more than one train is optional.

A first drafting means 40, comprising at least two sets of nip rolls or an inlet apron 42 and one set of nip rolls 44, is used to draft batt 36 in a direction perpendicular to the direction of orientation of the fibers of batt 36 as formed on floor apron 38. As used herein the terms stretching, drawing and drafting are synonymous. In FIGS. 1 and 2 the first drafting means comprises five sets of nip rolls 44, 46, 48, 50 and 52 and inlet apron 42 and outlet apron 54. Each set of nip rolls is shown as a one-over-two configuration, which works very well, but almost any arrangement can be used, such as a one-over-one, two-over-one, etc., as well as mixtures of nip roll configurations. The drafted batt 56 then is passed to needling means which in the embodiment shown comprises a first needled loom 57 and a second needle loom 60.

Needle looms such as first needle loom 57 and second needle loom 60 are well known in the art and commercially available from a number of manufacturers. In each needle loom 57 and 60 there is a needle board 58A and 61A respectively having a plurality of needles 58 and 61 respectively attached thereto which extend downward a distance below the bottom surface of each needle board. Each needle loom 57 and 60 comprises a means (not shown) for moving the needle board of each loom in a reciprocating motion having a first needling direction and a second needling direction. As well known in the art the needles in the needle board are aligned with holes in a bedplate (not shown) over which the object to be needled passes. The reciprocating motion of the needle board forces the needles in and out of the holes in the bedplate and thus in and out of the object to be needled since the object to be needled is positioned between the needle board and the bedplate. In a first needle loom 57, needles 58 comprise a blade which has at least 1 barb having a sharp point extending generally in the first needling direction of the reciprocating motion, referred to herein for convenience as the downward direction, wherein the points of the barbs of all of the needles 58 extend in the same direction. While it is possible to employ needles 58 having a large number of barbs, generally each needle has at least 1 to about 9 barbs attached to the blade.

In the second needle loom 60, needles 61 comprise a blade which has at least 1 first barb having a sharp point extending generally in the first needling direction (downward) of the reciprocating motion and at least 1 second barb which has a sharp point extending generally perpendicular from said blade or generally in the second needling direction of the reciprocating motion, referred to herein for convenience as the upward direction. While the number of first barbs and second barbs of each needle employed in needle loom 60 can be selected over a wide range, generally each needle 61 has at least 1 to about 3 first barbs and at least 1 to about 3 second barbs.

Figure 3:
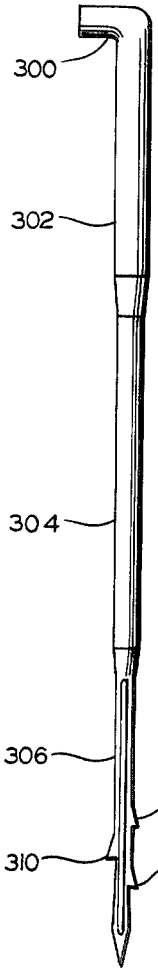
FIG. 3 is a side view of a needle suitable for use in a first needling means according to one embodiment of the invention.
Figure 4:
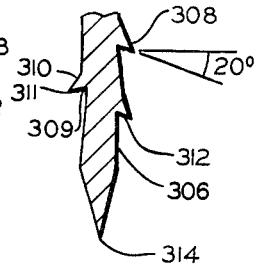
FIG. 4 is an enlarged cross section of the blades of the needle shown in FIG. 3.

The needle shown in FIG. 3 and FIG. 4 has been used as needle 58 in needle loom 57 with good results. The needle shown in FIG. 3 comprises the crank 300, shank 302, intermediate blade 304, blade 306, three barbs 308, 310 and 312, and tip 314. An enlarged portion of blade 306 of the needle shown in FIG. 3 is shown in FIG. 4 to more clearly show the barbs. Each of the three barbs shown on the needle in FIGS. 3 and 4 has the the same barb angle and where the needles employed in needle loom 57 each has two or more barbs, the barb angle is normally the same; however, if desired, a needle having two or more barbs can have two or more barb angles.

Figure 5:
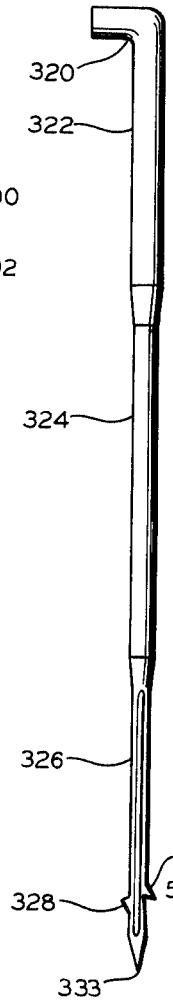
FIG. 5 is a side view of a needle suitable for use in a second needling means according to one embodiment of the invention.
Figure 6:
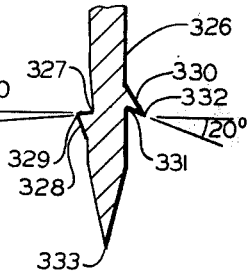
FIG. 6 is an enlarged cross section of the blade of the needle shown in FIG. 5.

Each barb shown in FIGS. 3 through 6 has a throat. In FIG. 4 the throat of barb 310 is indicated by reference numeral 309 which is an intersection of barb 310 and blade 306. In FIG. 6 the throat of barb 328 is indicated by reference numeral 327 which is an intersection of barb 328 and blade 326 and the throat of barb 330 is indicated by reference numeral 331 which is an intersection of barb 330 and blade 326. Also each barb shown in FIGS. 3 through 6 has a barb depth. As an example, the barb depth for barb 310 of FIG. 4 is the distance from throat 309 to the point 311 of the barb. The barb depth for barb 328 in FIG. 6 is the distance from throat 327 to the point 329 and the barb depth for barb 330 of FIG. 6 is the distance from throat 331 to the point 332. The barb depth for the needles in needle looms 57 and 60 can be selected over a wide range. As a general rule, the larger the denier, the larger the barb depth. For most nonwoven batts, the barb depth is within a range of about 1 to about 15 thousandths of an inch, although a barb depth within a range of about 2 to about 6 thousandths of an inch is commonly employed.

Another parameter for the needles used in the present invention in needle looms 57 and 60 is the barb angle. The barb angle can be selected over a wide range. The barb angle for the needle illustrated in FIG. 4 which is suitable for use in needle loom 57 is shown as 20°; however, the barb angle for the needles in needle loom 57 generally is within a range of about +5° to about +30° and more often from about +15° to about +25°. The barb angle is positive if the throat of the barb forms an acute angle between the barb and the blade forming the throat and the barb angle is negative if the throat of the barb forms an obtuse angle between the barb and the blade forming the throat.

The needle shown in FIGS. 5 and 6 has been used in needle loom 60 with good results. The needle shown in FIG. 5 comprises crank 320, shank 322, intermediate blade 324, blade 326, two barbs 328 and 330, and tip 333.

FIG. 6 represents an enlarged portion of blade 326 of the needle of FIG. 5 to more clearly show the barbs. As noted above the barb angle for the barbs on needles used in needle loom 60 can be selected over a broad range. The barb angle of barb 328 shown in FIG. 6 is −5°; however, the barb angle for the barb or barbs operating in the second needling direction of the reciprocating motion (upward direction) corresponding to barb 328 of FIG. 6 generally is within a range of 0° to about −20° and more often 0° to −10°. When the barb angle is 0°, then the sharp point of the barb generally extends in a direction perpendicular to the blade; however, when the barb angle is within the range of about −1° to about −20° then the sharp point of the barb is considered to generally extend in the second needling direction of the reciprocating motion. The barb angle of barb 330 shown in FIG. 6 is +20°; however, the barb angle for the barb or barbs operating in the first needling direction of the reciprocating motion (downward direction) corresponding to barb 330 of FIG. 6 generally is within a range of +5° to about +30° and more often +15° to about +25°.

The number of barbs employed for the needles in each of two or more needle looms, the barb angle, barb depth, etc., is easily determined by those skilled in the art. In making such a determination such factors as the composition of the staple fibers, the staple finish, the staple denier and length, the weight and thickness of the batt and the type and degree of crimp, if any, of the staple should be considered.

With regard to the physical design of the needles it is noted that the distance from the tip of the needle to the first barb and the distance between barbs along the length of the blade can be selected over a broad range. These aspects are not believed to be critical but they do determine to some degree what needle penetration should be used as described hereinafter.

The drafted, needled batt 62 is again drafted in the same direction as in the first drafting means by a second drafting means 63 comprising at least two sets of nip rolls 64 and 66 or an inlet apron and one set of nip rolls (not shown). The needled batt 68 which was drafted in a direction perpendicular to the direction of orientation of the fibers of batt 36 as formed on floor apron 38 both before and after needling is passed over roll 70 to a third drafting means, such as tenter frame 72. As shown clearly in FIG. 2, tenter frame 72 comprises a third drafting section 74, which drafts batt 68 in a direction parallel to the direction of orientation of the fibers of batt 36 as formed on floor apron 38. Tensioning section 76 which follows drafting section 74 is not used to draft the batt, but to subject the batt to tension in a direction parallel to the direction of orientation of the fibers of batt 36 as formed on floor apron 38.

The batt under tension in tensioning section 76 can be fused using infrared radiation. Infrared heaters 80 and 82 are shown in FIG. 2 positioned adjacent to and on opposite sides of unfused fabric. Either or both heaters can be used depending on the fusion desired. It is understood that the fabric of the present invention can be fused or an unfused fabric. In instances where an unfused fabric is desired infrared heaters 80 and 82 are not employed. It is preferred to fuse the fabric subjected to tension in section 76 because fusion of the fabric under tension improves the strength and dimensional stability of the fabric. Although other means can be used, it is preferred to fuse the fabric using infrared radiation because the depth of fusion can be controlled and the integrity of the fibers' cross section is maintained.

The fused or unfused fabric 84 is normally passed to a suitable surge means such as "J" box 96 and rolls 86, 88, 90, 92 and 94. From the surge means the fabric is passed to a windup means 110 over a plurality of rolls, surge and idler rolls, 98, 100, 102, 104, 106 and 108.

In the operation of the embodiment of the invention shown in the drawing, synthetic thermoplastic fibers in the form of staple are passed to carding machines 12,12' to produce carded webs 14,14'. The carded webs 14,14' are picked up by takeoff aprons 16,16' of crosslappers 20,20'. Lapper aprons 18,18' lay the carded webs on intermediate aprons 22,22' to produce an intermediate batt 24,24' which is passed to carding machines 26,26' to produce carded webs 28,28'. The carded webs 28,28' are picked up by takeoff aprons 30,30' of crosslappers 34,34' and these carded webs 28,28' are laid on floor apron 38 by lapper aprons 32,32' to produce a batt 36 with the fibers of batt 36 primarily orientated transverse to the direction of movement of floor apron 38. The number of webs used to form batt 36 depends upon a number of variables, such as the desired weight of the batt, the weight of the webs, the amount the batt is drafted during the process, etc. The batt 36 is then drafted in a direction perpendicular to the direction of orientation of the fibers by suitable means, such as the five sets of nip rolls 44, 46, 48, 50 and 52. When using nip rolls to practice the invention, only two sets of nip rolls actually are required to draft the batt; however, the use of more than two sets of nip rolls, such as the five nip rolls shown, provides a more uniform fabric since between any set of nip rolls a smaller drafting ratio can be used and still obtain the desired overall drafting ratio. In addition, batt 36 is frequently drafted between the nip formed by the feed apron and the first set of nip rolls 44. Batt 36 is drafted because each set of nip rolls is operated at a successively higher speed than the speed of the preceding inlet apron or set of nip rolls. Generally it has been found that utilization of more sets of nip rolls and smaller draft ratios between each set of nip rolls produces a more uniform fabric than utilization of fewer sets of nip rolls with higher draft ratios; however, at some point additional sets of nip rolls with reduced draft ratios between each set of nip rolls will not improve the product. In addition, there is a maximum speed at which the batt at a given weight can be produced due to the limitations of the batt-forming equipment. Thus, as in almost any process, the most economical operation requires consideration of a number of variables, and in particular the various parameters of the material processed. For example, some of the variables of the processed material which affect the drafting process are staple polymer, staple length and denier, staple finish, degree of crimp, weight of the batt, etc. Generally from about 2 to about 6 sets of nip rolls are utilized with an overall draft ratio ranging from about 1.01 to about 4 and a maximum draft ratio between sets of nip rolls of 2. However, a very good product can be produced utilizing from about 3 to 5 sets of nip rolls with an overall draft ratio ranging from about 1.2 to 1.8 and a maximum draft ratio between sets of nip rolls of 1.3.

Drafted batt 56 is then passed to the needling zone comprising needle loom 57 wherein the batt is preneedled to make a more coherent material and the preneedled batt 59 is passed to needle loom 60 to complete the needling operation. In the needling zone batt 56 is needle punched in needle loom 57 by penetrating batt 56 from the top surface through the bottom surface as shown in FIGS. 1 and 2 with needles in a reciprocating motion having a first needling direction and a second needling direction (a downward direction and an upward direction respectively as previously described). The needles used in needle loom 57 have at least one barb for catching staple fibers when said barb moves through the batt in the first or downward needling direction of the reciprocating motion thus producing preneedled batt 59. As previously described needles such as, for example, the one shown in FIGS. 3 and 4, are suitable for this purpose. Preneedled batt 59 is then further needled in needle loom 60 by penetrating batt 59 from the top surface through the bottom surface as shown in FIGS. 1 and 2 with needles in a reciprocating motion as similarly described for needle loom 57; however, in needle loom 60 the needles employed are substantially different as compared to the needles used in needle loom 57. In needle loom 60 each needle has at least a first barb which catches staple fibers when said first barb moves through the batt in the first or downward needling direction of said reciprocating motion and at least a second barb which catches staple fibers when said second barb moves through the batt in the second or upward needling direction of said reciprocating motion. The needle shown in FIGS. 5 and 6 is suitable for this purpose for example.

One or more needle looms can be used to practice the present invention, but if only one needle loom is used it is recommended to use a double board needle loom with the batt first needle punched with needles having at least one barb for catching staple fibers when said barb moves through batt 56 in the first or downward needling direction of the reciprocating motion to produce the preneedled batt which is then needled with needles having at least a first barb for catching staple fibers when the first barb moves through the batt in the first or downward needling direction and at least a second barb for catching staple fibers when the second barb moves through the batt in the second or upward needling direction. A double needle board loom provides the at least two needling zones required to practice the invention. It is noted that the batt will experience some drafting as it passes through the needle loom which must be taken into consideration in determining the operating speed of equipment positioned subsequent to the needle loom. It is not uncommon to experience drafting at a ratio in the range of from about 1.3 to about 2 through the needling means.

In accordance with the invention the needle penetration can be selected over a wide range. As used through the specification and claims and as normally understood by those skilled in the art the term "needle penetration" means the maximum distance the tip of the needles attached to the needle board move into the holes of the surface of the bedplate contiguous with the object to be needled. Generally the needle penetration is within the range of about $\frac{1}{4}$ to about $\frac{7}{8}$ of an inch, but more often the needle penetration is within the range of about $\frac{3}{8}$ to about $\frac{3}{4}$ of an inch. The minimum needle penetration is normally dictated by the design of the needles employed and in particular the distance from the tip of the needle to the barb farthest from the tip since it is generally desirable to have all the barbs on the needles pass completely through the batt to be needled.

The number of needle punches per square inch of the batt also can be selected over a wide range. Generally the batt is needle punched within a range of about 50 to about 500 punches per square inch per needle loom although frequently the batt is needle punched within a range of about 100 to about 300 punches per square inch per needle loom.

In the present invention the batt is subjected to needling in the first needle loom 57 (the first needling zone) employing needles having barbs which pull fibers of the batt substantially beyond the last surface of the batt penetrated by the barbs when said barbs are moving in the first needling direction of the reciprocating motion.

In the second needle loom 60 (the second needling zone) the preneedled batt from the first needle loom described above is needled employing needles having at least one first barb and at least one second barb. The at least one first barb pulls fibers of the batt substantially beyond the last surface of the batt penetrated by the barb when said first barb is moving in the first needling direction of the reciprocating motion. The at least one second barb pulls the fibers of the batt to approximately the position of the last surface penetrated by the second barb of the needles when said second barb is moving in the second needling direction of the reciprocating motion. Needling the batt in second needle loom 60 equipped with needles operating in this manner just described not only improves the strength and dimensional stability of the fabric, but also produces a fabric having a more uniform surface, that surface being the last surface penetrated by the second barb of the needles in the second needling zone when the second barb is moving in the second needling direction of the reciprocating motion.

The drafted, needle batt is again drafted in a direction essentially perpendicular to the direction of orientation of the fibers of batt 36 as formed on floor apron 38 in a second drafting means, such as employing nip rolls 64 and 66, and operating the speed of nip rolls 66 at a slightly higher speed than nip rolls 64. The draft ratio employed in the second drafting zone is also selected depending upon the material processed. Generally the draft ratio in the second drafting zone ranges from about 1.01 to about 2; however, a good product can be produced utilizing a draft ratio ranging from about 1.3 to about 1.5.

Needled batt 68 which has been drafted in a direction essentially perpendicular to the direction of orientation of the fibers of batt 36 as formed on floor apron 38 both before and after needling is then passed to a third drafting zone, such as tenter frame 72 which drafts the batt in a direction essentially parallel to the direction of orientation of the fibers of batt 36 as formed on floor apron 38 through the use of diverging tracks 73 which grasp the fabric at the inlet and draft the fabric as the tracks slowly diverge from one another. The drafting ratio employed in the third drafting zone depends upon a number of variables, such as staple length, denier, batt weight, needle density, etc. Generally the drafting ratio employed in the third drafting zone ranges from about 1.01 to about 1.5; however, a drafting ratio ranging from about 1.1 to about 1.3 can be used to produce a good product. Tenter frame 72 also contains a tensioning zone 76 which applies tension to fabric 78 while fabric 78 is subjected to some form of fusion to fuse the staple filaments of the fabric together such as infrared radiation. As noted above, the broad invention contemplates the production of an unfused as well as a fused fabric so the fusion step is an optional step. Thus one can practice the present invention even though the fabric 78 is not fused.

After fabric 78 passes the tensioning zone 76 the fabric 84 is passed to a surge zone such as "J" box 96 over a plurality of rolls and onto a takeup zone indicated by takeup means 110.

Various synthetic thermoplastic staple can be used in accordance with the present invention. For example, polyolefins such as polypropylene, polyesters such as polyethylene terephthalate, polyamides such as polycaprolactam, and mixtures thereof are suitable. Particularly good results have been obtained employing polypropylene staple. Also it is possible to use mixtures of natural and synthetic fibers in accordance with the present invention.

The synthetic staple suitable for use in applicant's invention can be selected from a broad range, but usually the staple has a length within a range of about 1½ to about 10 inches. Good results have been obtained employing a staple length with a range of about 2½ inches to about 6 inches. Staple denier can be selected from a wide range of deniers. Normally the denier is in a range of about 1 to 20; however, deniers within a range of about 1.5 to about 8 are more common.

The nonwoven fabrics produced according to the present invention can have a weight selected over a relatively broad range. Generally fabrics of the present invention have a weight within a range of about 1 to about 20 ounces per square yard although fabrics having a weight within a range of about 2 to about 8 ounces per square yard are commonly produced.

An important advantage of the above-described process and apparatus for producing nonwoven fabric using crosslappers is in the reduction of the traversal rate of speed of the crosslapper and associated equipment without a corresponding decrease in production. Also in the production of very light fabrics, web weights can be maintained sufficiently high so as to preclude doffing problems with the carding machines encountered with some prior art processes.

Also it is understood that a fused fabric is produced according to the invention by employing various other fusion means, such as hot rolls, a hot fluid chamber and the like.

One of the more common techniques for fusing a nonwoven batt of synthetic fibers other than with infrared heaters 80 and 82 is to pass the batt over one or more heated rolls. If a fused product is desired, heated rolls can be used rather than the infrared heating means 80 and 82 such as by heating rolls 86 and 88. Steam or some other energy source can be used to heat the surface of the rolls which is well known in the art.

Quartz heaters and foil-strip heaters have been used as the infrared heaters 80 and 82; however, any suitable infrared radiation source can be used if a fused fabric is desired which is fused with infrared radiation. At the present time it appears that the foil-strip heaters are preferred because they provide better control of the fusion process.

In general, fabrics with a variety of widths can be produced in accordance with the present invention; however, the invention is particularly applicable for the production of wide, nonwoven fabrics, that is, fabrics having a width ranging from about 108 to 230 inches.

The nonwoven fabrics of the present invention find a variety of uses as previously indicated. The fused nonwoven fabrics are useful in producing mildew-proof carpets. Nonwoven fabrics of the present invention which are fused on both sides can be used as primary carpet backing and said fabrics which are fused on one side can be used as secondary carpet backing.

Figure 7:
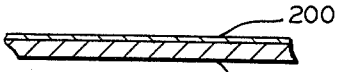
FIG. 7 is a schematic of a laminate produced employing a nonwoven fabric of the invention.

A fabric produced in accordance with the invention shown in FIGS. 1 and 2 which is unfused, that is, a fabric produced without using infrared heaters 80 and 82, has been used successfully as a substrate for a thin polymeric film to form a laminate. FIG. 7 shows a polymeric film 200 bonded to the nonwoven fabric 202. The nonwoven fabric of the present invention has been particularly well suited for this application because of the excellent physical properties of the fabric as compared to nonwoven fabrics produced without using the needling method and apparatus of the present invention.

The polymeric film which is suitable for use in producing laminates of the invention generally is three types, polyvinyl chloride, polyurethane and combinations of these two materials. Polyurethane usually produces a glossier finish than does polyvinyl chloride; and, in instances where both polymers are used, generally the polyvinyl chloride is next to the nonwoven fabric and the polyurethane is on top of the polyvinyl chloride which improves the glossiness of the laminate. Polyvinyl chloride is the preferred polymeric film since its appearance is good and polyvinyl chloride normally is cheaper than polyurethane.

A range of thicknesses of the polymeric film can be used; of course, only one thickness within reasonable limits is used to make a uniform laminate. Generally, the film thickness is in the range of from about 6 to 20 mils; however, good results have been produced in which the film thickness is more nearly within the range of from about 8 to about 15 mils.

The laminates of the invention are manufactured by employing one of a number of well-known processes, such as direct calender lamination, post lamination and transfer coating.

Direct calender lamination produces a very good laminate without the use of adhesives. The polymeric film acts as the adhesive because it is contacted with the nonwoven fabric shortly after extrusion and thus while the film is still hot and sticky.

Post lamination is another well developed method and differs from the direct calender lamination technique in that the polymeric film is not usually extruded just prior to the bonding step and an adhesive is applied to the polymeric film before the film is contacted with the nonwoven fabric. A roll of polymeric film is generally the source of the film, and a thin layer of adhesive is applied to the side of the film which is to be boded to the nonwoven fabric. The adhesive is applied by a suitable means usually in an amount in the range of from about 1 to about 5 oz./yd.$^2$ depending upon the adhesive. The coated film then is contacted with the nonwoven fabric thereby producing a good, strong, leather-like fabric.

Adhesives suitable for use in the post lamination technique are well known in the art. Plastisols are one of the best known materials. These are dispersions of finely divided polymeric materials in nonvolatile organic liquid and low melting solids, generally referred to as plasticizers. Suitable plasticizers include phthalate, adipate and sebaccate esters and polyols such as ethylene glycol and its derivatives. A typical plastisol composition is 100 parts polymeric material and 50 parts plasticizer, forming a paste which gels when heated to about 300° F. as a result of solvation of the resin particles by the plasticizer. If a volatile solvent is included in the plastisol, then the adhesive generally is referred to as an organosol which also is suitable for use in the invention.

The transfer coating method is most often used when a blowing agent is incorporated into the polymeric film thereby ultimately producing an expanded laminate. In some instances it has been found that the temperatures which activate the blowing agent may bee too high for use of some of the materials otherwise useful in the invention to produce the nonwoven fabric. For example, a nonwoven fabric of polypropylene staple may shrink excessively at temperatures normally required to activate a blowing agent in a film of polyvinyl chloride.

The laminate of the invention possesses qualities which make it particularly well suited for use as upholstery material to provide a relatively inexpensive leather-like material which has good tear strength and grab strength.

EXAMPLES

Three nonwoven fabrics were produced to demonstrate the improved fabric of the present invention. Two of the fabrics were produced by the apparatus shown in FIGS. 1 and 2 but without employing the needling method and apparatus of the present invention. These two fabrics are labeled Control I and Control II and they were produced employing a needle similar to that shown in FIGS. 3 and 4 in both needle looms. The needles had three barbs with a barb angle of +20°. The barb depth was 3 thousandths of an inch and the blade size was 25 wire gauge. The needle was manufactured by the Foster Needle Co., Manitowoc, Wisconsin. The needle had open barbs with no kickup and a long lead in. The tip of the needle was ⅛ of an inch from the nearest barb and the center barb was spaced ⅛ of an inch from the other two. The third fabric was produced in accordance with the invention and labeled Inventive Fabric.

The inventive fabric was produced in accordance with the process and apparatus as shown in FIGS. 1 and 2 in which the batt was needle punched in needle loom 57 using the needle similar to that shown in FIGS. 3 and 4 and as described in production of the control fabrics. The preneedled batt 59 was needled in needle loom 60 using the needle similar to that shown in FIGS. 5 and 6 in accordance with the invention. The needles used in needle loom 60 were manufactured by the Foster Needle Co., Manitowoc, Wisconsin. Each needle had two barbs which were both positioned ⅛ of an inch from the tip of the needle. One barb as shown in FIGS. 5 and 6 had a barb angle of −5° and the other barb as shown in FIGS. 5 and 6 had a barb angle of +20°. Both barbs had a long lead in. The blade of the needle was 25 wire gauge. All three fabrics were made using 3 denier polypropylene staple having a length of 4 inches. The batt was needle punched at 225 punches per square inch per needle loom with a needle penetration of ⅝ inch in each loom. All three fabrics were unfused. A comparison of the properties of the fabrics is shown in Table I below:

TABLE I

| | Control I | Control II | Inventive Fabric |
|---|---|---|---|
| Wt. oz/yd$^2$ | 4.1 | 4.1 | 4.0 |
| Tear Strength[a], lbs. | | | |
| Warp[e] | 25 | 27 | 32 |
| Fill[f] | 30 | 35 | 38 |
| Elongation[b] @ 10 lbs., % | | | |
| Warp | 1.94 | 1.9 | 1.2 |
| Fill | 1.8 | 1.4 | 1.1 |
| Ultimate Strength[c], lbs. | | | |
| Warp | 55 | 60 | 78 |
| Fill | 77 | 86 | 104 |
| Ball Burst[d] | 158 | 153 | 195 |

[a]ASTM D 2261-64T
[b]ASTM D 1682-64
[c]ASTM D 1682-64
[d]ASTM D 231-62
[e]As used above the term "warp" means that the particular property of the fabric was evaluated in a direction parallel to the direction the batt was drafted in the first drafting means of FIGS. 1 and 2.
[f]As used above the term "fill" means that the particular property of the fabric was evaluated in a direction transverse to the direction the batt was drafted in the first drafting means of FIGS. 1 and 2.

The above results show that the inventive fabric provides the best properties in each and every category tested. The increase in ball burst of approximately 25% as compared to the control fabrics is particularly noteworthy.

That which is claimed is:

1. A method for needling a nonwoven batt of staple fibers comprising:

passing a nonwoven batt of staple fibers to at least two needling zones, said batt having a first surface and a second surface, needling the batt in a first needling zone by penetrating said first and second surfaces of said batt with needles in a reciprocating motion having a first needling direction and a second needling direction wherein each needle in said first needling zone has a blade with at least one barb attached thereto, said at least one barb catching staple fibers when said barb moves through said batt in the first needling direction of said reciprocating motion, passing the thus-needled batt to a second needling zone, and needling the batt in said second needling zone by penetrating said first and second surfaces of said batt with needles in said reciprocating motion wherein each needle in said second needling zone comprises a blade having at least a first barb attached thereto which catches staple fibers when said first barb moves through said batt in the first needling direction of said reciprocating motion and at least a second barb attached thereto which catches staple fibers when said second barb moves through said batt in the second needling direction of said reciprocating motion.

2. A method according to claim 1 wherein the barbs on the needles in the first needling zone and the first barbs on the needles in the second needling zone pull fibers of the batt substantially beyond the last surface of the batt penetrated by the barbs when said barbs are moving in the first direction of said reciprocating motion and the second barbs on the needles in the second needling zone pull the fibers of the batt to approximately the position of the last surface penetrated by the second barbs of the needles in the second needling zone when said second barbs are moving in the second direction of said reciprocating motion.

3. A method according to claim 1 wherein the weight of the batt to be needled is within a range of about 1 to about 15 ounces per square yard, the length of the staple fibers is within a range of about 1½ to about 10 inches, the denier of the staple fibers is within a range of about 1 to about 20, the needle penetration in the first and second needling zones is within a range of about ¼ to about ⅞ inch and the batt is needle punched within a range of about 50 to about 500 punches per square inch per needling zone.

4. A method according to claim 1 wherein the weight of the batt to be needled is within a range of about 2 to about 8 ounces per square yard, the length of the staple fibers is within a range of about 2½ to about 6 inches, the denier of the staple fibers is within a range of about 1.5 to about 8, the needle penetration in the first and second needling zones is within a range of about ⅜ to about ¾ inch and the batt is needle punched within a range of about 100 to about 300 punches per square inch per needling zone.

5. A method according to claim 1 wherein the staple fibers are synthetic thermoplastic fibers selected from the group consisting of polyolefin, polyester and polyamide fibers.

6. A method according to claim 1 wherein the staple fibers comprise polypropylene fibers.

7. A method according to claim 1 wherein the needles employed in the first needling zone have from at least 1 to about 9 barbs attached to the blade and the needles employed in the second needling zone have at least 1 to about 3 first barbs attached to the blade and at least 1 to about 3 second barbs attached to the blade.

8. A method according to claim 7 wherein the barbs attached to the blades of the needles employed in the first needling zone and the first barbs attached to the blades of the needles employed in the second needling zone have a barb angle within a range of about +5 to about +30 degrees and a total barb depth within a range of about 1 to about 15 thousandths of an inch, and the second barbs attached to the blades of the needles employed in the second needling zone have a barb angle within a range of about 0 to about −20 degrees and a total barb depth within a range of about 1 to about 15 thousandths of an inch.

9. A method according to claim 1 wherein the needles employed in the first needling zone have 3 barbs attached to the blade and the needles employed in the second needling zone have 1 first barb and 1 second barb attached to the blade.

10. A method according to claim 9 wherein the barbs attached to the blades of the needles employed in the first needling zone and the first barbs attached to the blades of the needles employed in the second needling zone have a barb angle within a range of about +15° to about +25° degrees and a total barb depth within a range of about 2 to about 6 thousandths of an inch, and the second barbs attached to the blades of the needles employed in the second needling zone have a barb angle within a range of about 0° to about −10° degrees and a total barb depth within a range of about 2 to about 6 thousandths of an inch.

11. A method according to claim 9 wherein the 3 barbs attached to each blade of the needles employed in the first needling zone and the 1 first barb attached to each blade of the needles employed in the second needling zone have a barb angle of about +20 degrees and a total barb depth of about 3 thousandths of an inch, and the 1 first barb attached to each blade of the needles employed in the second needling zone has a barb angle of about −5 degrees and a total barb depth of about 3.3 thousandths of an inch.

12. A needled nonwoven batt of staple fibers produced in accordance with the method of claim 1.

13. An improved method for the production of a nonwoven fabric comprising, in combination, the steps of:

forming a batt comprising staple fibers wherein said staple fibers are positioned primarily in a first direction, said batt having a first surface and a second surface;

passing said batt to a first drafting zone;

drafting said batt in said first drafting zone in a second direction, said second direction being approximately perpendicular to said first direction;

passing the thus-drafted batt to at least two needling zones;

needling the batt in a first needling zone by penetrating said first and second surfaces of said batt with needles in a reciprocating motion having a first needling direction and a second needling direction wherein each needle in said first needling zone has a blade with at least one barb attached thereto, said at least one barb catching staple fibers when said barb moves through said batt in the first needling direction of said reciprocating motion;

passing the thus-needled batt to a second needling zone;

needling the batt in said second needling zone by penetrating said first and second surfaces of said batt with needles in said reciprocating motion wherein each needle in said second needling zone comprises a blade having at least a first barb attached thereto which catches staple fibers when said first barb moves through said batt in the first needling direction of said reciprocating motion and at least a second barb attached thereto which catches staple fibers when said second barb moves through said batt in the second needling direction of said reciprocating motion;

drafting said needled batt in a second drafting zone in said second direction; and drafting said batt in a third drafting zone in said first direction.

14. A method in accordance with claim 13 wherein said batt is formed by crosslapping webs comprising said staple fibers.

15. A method according to claim 13 wherein at least a portion of the fibers of the batt are fused subsequent to drafting the batt in the first direction in the third drafting zone.

16. A method according to claim 13 wherein at least a portion of the fibers of the batt are fused by infrared fusion subsequent to drafting said batt in the first direction in the third drafting zone but while said batt is still subjected to drafting tension in at least the first direction.

17. A method according to claim 13 wherein the first drafting zone and the second drafting zone each comprises at least two sets of nip rolls operated in series wherein each set of nip rolls trasverses the batt and wherein each successive set of nip rolls is operated at a higher speed than the preceding set of nip rolls and wherein the third drafting zone comprises a tenter frame.

18. A method according to claim 17 wherein the drafting ratio employed in the first drafting zone is within the range of about 1.01 to about 4 with a maximum drafting ratio of 2 between adjacent sets of nip rolls, the drafting zone employed in the second drafting zone is within a range of about 1.01 to about 2, and the drafting ratio employed in the third drafting zone is within a range of about 1.01 to about 1.5.

19. A method according to claim 17 wherein the drafting ratio employed in the first drafting zone is within a range of about 1.2 to about 1.8 with a maximum drafting ratio of 1.3 between adjacent sets of nip rolls, the drafting ratio employed in the second drafting zone is within a range of about 1.3 to about 1.5, and the drafting ratio employed in the third drafting zone is within a range of about 1.1 to about 1.3.

20. A method according to claim 13 wherein the weight of the batt to be needled is within a range of about 1 to about 15 oz./sq. yd., the length of the staple fibers is within a range of about 1½ to 10 inches, the denier of the staple fibers is within a range of about 1 to about 10, the needle penetration in the first and second needling zones is within a range of about ¼ to about ⅞ inch and the batt is needle punched within a range of about 100 to about 1000 punches per square inch.

21. A method according to claim 13 wherein the weight of the batt to be needled is within a range of about 2 to about 8 oz./sq. yd., the length of the staple fibers is within a range of about 2½ to 6 inches, the denier of the staple fibers is within a range of about 1.5 to about 8, the needle penetration in the first and second needling zones is within a range of about ⅜ to about ¾ inch and the batt is needle punched within a range of about 300 to about 600 punches per square inch.

22. A method according to claim 13 wherein the staple fibers are synthetic fibers selected from the group consisting of polyolefin, polyester and polyamide.

23. A method according to claim 13 wherein the staple fibers comprise polypropylene.

24. A method according to claim 13 wherein the needles employed in the first needling zone have from at least 1 to about 9 barbs attached to the blade and the needles employed in the second needling zone have at least 1 to about 3 first barbs attached to the blade and at least 1 to about 3 seconds barbs attached to the blade.

25. A method according to claim 24 wherein the barbs attached to the blades and the needles employed in the first needling zone and the first barbs attached to the blades and the needles employed in the second needling zone have a barb angle within a range of about +5 to about +30 degrees and a total barb depth within a range of about 1 to about 15 thousandths of an inch, and the second barbs attached to the blades and the needles employed in the second needling zone have a barb angle within a range of about 0 to about −20 degrees and a total barb depth within a range of about 1 to about 15 thousandths of an inch.

26. A method according to claim 13 wherein the needles employed in the first needling zone have 3 barbs attached to the blade and the needles employed in the second needling zone have 1 first barb and 1 second barb attached to the blade.

27. A method according to claim 26 wherein wherein the barbs attached to the blades of the needles employed in the first needling zone and the first barbs attached to the blades of the needles employed in the second needling zone have a barb angle within a range of about +15° to about +25° degrees and a total barb depth within a range of about 2 to about 6 thousandths of an inch, and the second barbs attached to the blades of the needles employed in the second needling zone have a barb angle within a range of about 0° to about −10° degrees and a total barb depth within a range of about 2 to about 6 thousandths of an inch.

28. A method according to claim 26 wherein the 3 barbs attached to each blade of the needles employed in the first needling zone and the first barb attached to each blade of the needles employed in the second needling zone have a barb angle of about +20 degrees and a total barb depth of about 3 thousandths of an inch, and the one first barb attached to each blade of the needles employed in the second needling zone has a barb angle of about −5 degrees and a total barb depth of about 3.3 thousandths of an inch.

29. A nonwoven fabric produced in accordance with the method of claim 13.

30. A laminate comprising a polymeric film bonded to a fabric wherein said fabric is produced in accordance with the method of claim 13.

31. A laminate in accordance with claim 30 wherein the polymeric film has a film thickness within a range of about 6 to about 20 mils and the polymeric film is selected from the group consisting of polyvinyl chloride, polyurethane and combinations thereof.

* * * * *